US008789319B2

(12) United States Patent
Li et al.

(10) Patent No.: US 8,789,319 B2
(45) Date of Patent: Jul. 29, 2014

(54) SEISMIC-INCURRED-RUPTURE-RESISTANT DEFORMATION-RECORDABLE BUCKLING-RESTRAINED BRACE AND FABRICATING METHOD THEREOF

(75) Inventors: Guoqiang Li, Shanghai (CN); Feifei Sun, Shanghai (CN); Tianji Li, Shanghai (CN); Xiaokang Guo, Shanghai (CN)

(73) Assignee: Tongji University, Shanghai (CN)

( * ) Notice: Subject to any disclaimer, the term of this patent is extended or adjusted under 35 U.S.C. 154(b) by 0 days.

(21) Appl. No.: 13/696,501

(22) PCT Filed: Oct. 9, 2011

(86) PCT No.: PCT/CN2011/080558

§ 371 (c)(1), (2), (4) Date: Nov. 6, 2012

(87) PCT Pub. No.: WO2013/040811

PCT Pub. Date: Mar. 28, 2013

(65) Prior Publication Data

US 2014/0041320 A1 Feb. 13, 2014

(30) Foreign Application Priority Data

Sep. 22, 2011 (CN) ..... 2011 1 0283454

(51) Int. Cl.
*E04B 1/98* (2006.01)
*E04H 9/02* (2006.01)

(52) U.S. Cl.
USPC ..... 52/167.3; 52/167.1; 188/378; 267/136

(58) Field of Classification Search
CPC ..... E04B 1/98; E04B 1/985; E04B 9/02; E04B 9/021; E04B 9/023; E04B 9/024; E04B 9/025
USPC ..... 52/1, 167.1, 167.2, 167.3, 167.4, 167.5, 52/167.6, 167.7, 167.8, 167.9, 223.13, 52/638, 834, 843; 188/378, 379, 380, 381; 248/570, 636; 267/136
See application file for complete search history.

(56) References Cited

U.S. PATENT DOCUMENTS 3,025,032 A * 3/1962 Leja ..... 248/590
3,046,553 A * 7/1962 Hawkins et al. ..... 346/17

(Continued)

FOREIGN PATENT DOCUMENTS

CN 201078050 Y 6/2008
CN 100560884 C 11/2009

(Continued)

*Primary Examiner* — Basil Katcheves
*Assistant Examiner* — Rodney Mintz
(74) *Attorney, Agent, or Firm* — Global IP Services; Tianhua Gu

(57) ABSTRACT

A seismic-incurred-rupture-resistant deformation-recordable buckling-restrained brace is disclosed. A core plate is disposed in the concrete filled steel tubular outer sleeve, and an end portion of the core plate is provided with a core plate stiffening rib. A brace deformation recording device includes two toothed racks, a ratchet gear, a first cord spool, and a second cord spool. The two toothed racks are fixed on the core plate stiffening rib, and ratchet pawls in the length direction thereof face opposite directions. The ratchet gear is fixedly connected to the concrete filled steel tubular outer sleeve. The ratchet gear is disposed between the two toothed racks. A tooth on the ratchet gear is engaged with a ratchet pawl. The first cord spool is fixed on the ratchet gear. The second cord spool is fixed on the core plate stiffening rib.

8 Claims, 6 Drawing Sheets

(56) References Cited

U.S. PATENT DOCUMENTS

| | | | | | |
|---|---|---|---|---|---|
| 3,143,946 | A * | 8/1964 | Merten | 355/2 |
| 3,158,832 | A * | 11/1964 | Skelton | 367/64 |
| 3,204,246 | A * | 8/1965 | Ikard et al. | 346/33 C |
| 3,426,869 | A * | 2/1969 | Platus et al. | 188/372 |
| 3,721,320 | A * | 3/1973 | Hirsch | 188/374 |
| 3,833,093 | A * | 9/1974 | Robinson | 188/374 |
| 4,371,143 | A * | 2/1983 | Ishida et al. | 248/638 |
| 4,397,069 | A * | 8/1983 | Camossi | 29/896.93 |
| 4,715,469 | A * | 12/1987 | Yasuda et al. | 181/102 |
| 5,005,326 | A * | 4/1991 | Ishimaru et al. | 52/167.2 |
| 5,097,547 | A * | 3/1992 | Tanaka et al. | 52/167.1 |
| 5,245,807 | A * | 9/1993 | Ishimaru et al. | 52/167.2 |
| 5,288,060 | A * | 2/1994 | Tyutinman | 267/154 |
| 5,382,008 | A * | 1/1995 | Tyutinman | 267/154 |
| 5,471,810 | A * | 12/1995 | Sugisawa et al. | 52/836 |
| 5,560,162 | A * | 10/1996 | Kemeny | 52/167.3 |
| 5,727,663 | A * | 3/1998 | Taylor | 188/378 |
| 5,799,924 | A * | 9/1998 | Slocum et al. | 248/636 |
| 5,842,312 | A * | 12/1998 | Krumme et al. | 52/167.1 |
| 6,098,969 | A * | 8/2000 | Nagarajaiah | 267/136 |
| 6,115,973 | A * | 9/2000 | Goto | 52/167.4 |
| 6,125,596 | A * | 10/2000 | Goto | 52/167.4 |
| 6,220,410 | B1 * | 4/2001 | Robinson | 188/371 |
| 6,530,182 | B2 * | 3/2003 | Fanucci et al. | 52/167.3 |
| 6,672,573 | B2 * | 1/2004 | Berton | 267/136 |
| 6,681,538 | B1 * | 1/2004 | Sarkisian | 52/289 |
| 6,701,680 | B2 * | 3/2004 | Fanucci et al. | 52/167.3 |
| 6,826,874 | B2 * | 12/2004 | Takeuchi et al. | 52/167.3 |
| 7,000,304 | B2 * | 2/2006 | Sarkisian | 29/434 |
| 7,185,462 | B1 * | 3/2007 | Smelser | 52/167.3 |
| 7,373,758 | B2 * | 5/2008 | Tsai et al. | 52/834 |
| 7,549,257 | B2 * | 6/2009 | Chuang | 52/167.1 |
| 7,621,085 | B2 * | 11/2009 | Commins | 52/293.3 |
| 7,650,962 | B2 * | 1/2010 | Quinn et al. | 181/121 |
| 7,707,788 | B2 * | 5/2010 | Bystricky et al. | 52/167.3 |
| 8,250,818 | B2 * | 8/2012 | Tremblay et al. | 52/167.3 |
| 8,316,589 | B2 * | 11/2012 | Chou et al. | 52/167.1 |
| 8,353,134 | B2 * | 1/2013 | Jiang et al. | 52/167.1 |
| 8,424,252 | B2 * | 4/2013 | Tsai et al. | 52/167.3 |
| 8,464,477 | B2 * | 6/2013 | Bowlus et al. | 52/167.4 |
| 8,590,258 | B2 * | 11/2013 | Hinchman | 52/741.1 |
| 8,621,791 | B2 * | 1/2014 | Mualla | 52/167.3 |
| 2001/0000840 | A1 * | 5/2001 | Takeuchi et al. | 52/167.1 |
| 2001/0054785 | A1 * | 12/2001 | Berton | 267/136 |
| 2002/0095879 | A1 * | 7/2002 | Fanucci et al. | 52/167.3 |
| 2003/0205008 | A1 * | 11/2003 | Sridhara | 52/167.3 |
| 2004/0000104 | A1 * | 1/2004 | Fanucci et al. | 52/167.3 |
| 2004/0190981 | A1 * | 9/2004 | Tsai et al. | 403/293 |
| 2004/0247378 | A1 * | 12/2004 | Sarkisian | 403/83 |
| 2005/0005539 | A1 * | 1/2005 | Nakamura et al. | 52/167.3 |
| 2005/0055968 | A1 * | 3/2005 | Takeuchi et al. | 52/720.1 |
| 2005/0166487 | A1 * | 8/2005 | Tsai | 52/167.3 |
| 2005/0257490 | A1 * | 11/2005 | Pryor et al. | 52/736.3 |
| 2006/0037275 | A1 * | 2/2006 | Jen et al. | 52/656.9 |
| 2006/0101733 | A1 * | 5/2006 | Jen et al. | 52/167.1 |
| 2006/0156657 | A1 * | 7/2006 | Commins | 52/223.13 |
| 2007/0056225 | A1 * | 3/2007 | Takeuchi et al. | 52/167.1 |
| 2007/0240368 | A1 * | 10/2007 | Tsai et al. | 52/167.3 |
| 2008/0016794 | A1 * | 1/2008 | Tremblay et al. | 52/167.4 |
| 2008/0029012 | A1 * | 2/2008 | Stokkeland | 114/253 |
| 2008/0192570 | A1 * | 8/2008 | Lennart Tenghamn et al. | 367/17 |
| 2008/0229683 | A1 * | 9/2008 | Bystricky et al. | 52/167.3 |
| 2009/0133338 | A1 * | 5/2009 | Thompson et al. | 52/167.1 |
| 2009/0194380 | A1 * | 8/2009 | Ali et al. | 188/381 |
| 2009/0211180 | A1 * | 8/2009 | Smelser | 52/167.1 |
| 2010/0005737 | A1 | 1/2010 | Tsai et al. | |
| 2010/0018134 | A1 * | 1/2010 | Tsai | 52/167.3 |
| 2010/0319274 | A1 * | 12/2010 | Tsai | 52/167.3 |
| 2011/0041424 | A1 * | 2/2011 | Jiang et al. | 52/167.1 |
| 2011/0127704 | A1 * | 6/2011 | Zeilenga et al. | 267/136 |
| 2011/0139055 | A1 * | 6/2011 | Stokkeland et al. | 114/253 |
| 2011/0297476 | A1 * | 12/2011 | Harper et al. | 181/121 |
| 2012/0000147 | A1 * | 1/2012 | Chou et al. | 52/167.1 |
| 2012/0145476 | A1 * | 6/2012 | Kamata | 181/121 |
| 2012/0233955 | A1 * | 9/2012 | Tsai et al. | 52/653.1 |
| 2012/0260585 | A1 * | 10/2012 | Mualla | 52/167.1 |
| 2012/0266548 | A1 * | 10/2012 | Tremblay et al. | 52/167.3 |
| 2013/0042546 | A1 * | 2/2013 | Bowlus et al. | 52/167.4 |
| 2013/0139452 | A1 * | 6/2013 | Tsai et al. | 52/167.3 |
| 2013/0152490 | A1 * | 6/2013 | Hinchman | 52/167.3 |
| 2013/0205690 | A1 * | 8/2013 | Hinchman | 52/167.3 |
| 2013/0326969 | A1 * | 12/2013 | Kienholz et al. | 52/167.2 |
| 2014/0059950 | A1 * | 3/2014 | Marinovic et al. | 52/167.3 |

FOREIGN PATENT DOCUMENTS

| | | | |
|---|---|---|---|
| CN | 201627381 | | 11/2010 |
| CN | 101220616 | B | 5/2011 |
| JP | 2003343116 | A | 12/2003 |
| WO | WO 2008115480 | A1 | 9/2008 |
| WO | WO 2009142040 | A1 * | 11/2009 |

* cited by examiner

SEISMIC-INCURRED-RUPTURE-RESISTANT DEFORMATION-RECORDABLE BUCKLING-RESTRAINED BRACE AND FABRICATING METHOD THEREOF

CROSS REFERENCE TO RELATED PATENT APPLICATION

The present application is the US national stage of PCT/CN2011/080558 filed on Oct. 9, 2011, which claims the priority of the Chinese patent application No. 201110283454.0 filed on Sep. 22, 2011, which application is incorporated herein by reference.

BACKGROUND OF THE PRESENT INVENTION

1. Field of Invention

The present invention relates to a buckling-restrained brace member applied in the field of structural engineering, and more particularly to a seismic-incurred-rupture-resistant deformation-recordable buckling-restrained brace and a fabricating method thereof.

2. Description of Related Arts

The steel braced frame structure has desirable seismic performance. However, during strong earthquake, the steel braced frame structure is subject to the reciprocating earthquake action, and a regular steel brace is likely to buckle under compression, thus decreasing the seismic capacity of the structure, which is very unfavorable to the structural safety. A buckling-restrained brace does not buckle when subject to axial compression, has bearing capacities being equivalent under tension and compression, has plump hysteresis curves, and has desirable energy dissipation capacity and low cyclic fatigue properties, which are advantages thereof. The concept of buckling restrained energy dissipating brace was put forward firstly by Yoshino in 1971, and the experimental study on the buckling-restrained brace using a shear wall with external restrainers has been performed. Afterwards, many scholars have studied the force bearing performance of buckling-restrained brace members in various forms. Furthermore, some other scholars have studied the overall seismic performance of structures adopting buckling-restrained braces. In addition to the USA and Japan, the Chinese mainland and the Taiwan region have achieved many results on the study and application of the buckling-restrained braces.

However, the core of a conventional buckling-restrained brace will break under tension after reaching the fatigue limit thereof, so as to lose the bearing capacity under tension, which incurs a weak layer to the structure, thereby increasing structural loads and accelerating structural damage. In the prior art, the buckling-restrained brace cannot record the accumulated deformation and the maximum deformation in earthquakes, and therefore cannot provide basis for repairing and replacement of the buckling-restrained brace after the earthquakes; the problem of asymmetric tension and compression of a brace in the shape of an inverted Y cannot be solved either, which incurs an additional strong internal shearing force to a beam and thus is very unfavorable to the structural safety.

SUMMARY OF THE PRESENT INVENTION

The present invention provides a seismic-incurred-rupture-resistant deformation-recordable buckling-restrained brace and a fabricating method thereof, so as to eliminate the problems in the prior art.

A seismic-incurred-rupture-resistant deformation-recordable buckling-restrained brace includes a concrete filled steel tubular outer sleeve, a core plate being disposed in the concrete filled steel tubular outer sleeve, an end portion of the core plate being provided with a core plate stiffening rib, and further includes a brace deformation recording device. The brace deformation recording device includes two toothed racks, a ratchet gear, a first cord spool, and a second cord spool. The two toothed racks are fixed on the core plate stiffening rib. The ratchet gear is connected to the concrete filled steel tubular outer sleeve. A row of ratchet pawls is disposed on a length direction of each toothed rack. The direction of the ratchet pawls on one toothed rack is opposite to that of the ratchet pawls on the other toothed rack. Two sides of the ratchet gear are engaged with the ratchet pawls on the two toothed racks respectively. The first cord spool is fixed on a shaft center of the ratchet gear. The second cord spool is fixed on the core plate stiffening rib. One end of a cord is wound on the second cord spool, and the other end of the cord is fixed on the first cord spool. When deforming, the core plate drives the two toothed racks to move relative to the concrete filled steel tubular outer sleeve. The ratchet pawl drives the ratchet gear and the first cord spool to rotate in a unidirectional manner, and winds a part of the cord from the second cord spool onto the first cord spool.

In the present invention, the toothed rack is provided with a mounting slot along the length direction, the ratchet pawls are disposed in the mounting slot, each ratchet pawl includes a first side surface and a second side surface, top portions of the first side surface and the second side surface converge to form an acute angle, a root portion of the first side surface is connected to a first pin, the first pin is connected to an extendable and retractable mechanism, the extendable and retractable mechanism is located in an extension and retraction slot, a pin slide slot along a depth direction of the extension and retraction slot is disposed in the extension and retraction slot, two ends of the first pin are able to slide in the pin slide slot, a root portion of the second side surface is connected to a second pin, and the second pin is fixedly mounted in the mounting slot.

In the present invention, inner sides of the toothed racks are each provided with a pointer slide slot along the length direction, the brace deformation recording device further includes two pointers, the two pointers are located on two sides of the ratchet gear respectively, and two ends of each of the pointers are inserted into the pointer slide slots on the two toothed racks.

In the present invention, one end of the core plate stiffening rib is located outside the concrete filled steel tubular outer sleeve, and the brace deformation recording device is disposed on the core plate stiffening rib outside the concrete filled steel tubular outer sleeve.

In the present invention, a ratchet gear cover is disposed above the ratchet gear. The first cord spool has one end fixed on the ratchet gear and the other end disposed in a bearing on the ratchet gear cover. The ratchet gear cover is fixedly connected to the end portion of the concrete filled steel tubular sleeve.

In the present invention, multiple cables are symmetrically distributed in the concrete filled steel tubular outer sleeve, and two ends of each of the cables are fixed on the core plate stiffening rib at the two ends of the core plate.

In the present invention, the cable is inserted into a bushing.

In the present invention, two ends of the concrete filled steel tubular outer sleeve are provided with two sealing plates, namely, the front one and the rear one, a fixing plate is disposed between the two sealing plates, the fixing plate is fixed on the core plate stiffening rib, and the cables run through the front sealing plate and the fixing plate, and then are fixed through an anchorage device.

A fabricating method of a seismic-incurred-rupture-resistant deformation-recordable buckling-restrained brace of the present invention includes the following steps:

(1) fabricating a core plate part: welding a core plate and a stiffening rib parallel with the core plate together through a butt weld, and welding the core plate and a stiffening rib perpendicular to the core plate together through a fillet weld;

(2) welding a fixing plate and the stiffening rib together through a fillet weld, and preparing a hole on the fixing plate;

(3) placing a cable into a bushing, an end portion of the cable running through the hole of the fixing plate, and using an anchorage device for anchoring;

(4) arranging a compressible delamination adhesive material layer around the core plate;

(5) placing a front sealing plate in front of the fixing plate, welding the front sealing plate and an inner wall of a square steel tube together through a fillet weld, pouring lightweight concrete into the square steel tube, and fixedly placing another front sealing plate in front of another fixing plate, so as to fabricate a concrete filled steel tubular outer sleeve;

(6) welding the rear sealing plate and two cross-sections of the square steel tube together through fillet welds; and (7) mounting and fixing a brace deformation recording device, the brace deformation recording device including two toothed racks, a ratchet gear, a first cord spool, and a second cord spool, fixing the two toothed racks on the core plate stiffening rib, fixedly connecting the ratchet gear to the rear sealing plate, disposing the ratchet gear between the two toothed racks, a tooth on the ratchet gear being engaged with a ratchet pawl on the toothed rack, the ratchet gear driven by the toothed rack rotating, fixing a first cord spool on the ratchet gear, fixing a second cord spool on the core plate stiffening rib, winding a cord onto the second cord spool, and fixing an end portion of the cord on the first cord spool.

According to the technical solutions, in the seismic-incurred-rupture-resistant deformation-recordable buckling-restrained brace and the fabricating method thereof in the present invention, the brace deformation recording device can record accumulated plastic deformation and maximum deformation undergone by the buckling-restrained brace during earthquakes, so as to provide reliable basis for determination of the degree of damage to the brace and whether post-earthquake replacement is required. In addition to the seismic-incurred-rupture-resistant function, the cable further has the function of compensating asymmetric tension and compression. Compared with a regular buckling-restrained brace, the present invention achieves greater safety and better mechanical properties, can prevent adverse effects incurred to the structure by fatigue rupture of the buckling-restrained brace, and can record the accumulated deformation and the maximum deformation of the buckling-restrained brace.

DETAILED DESCRIPTION OF THE PREFERRED EMBODIMENTS

Figure 1:
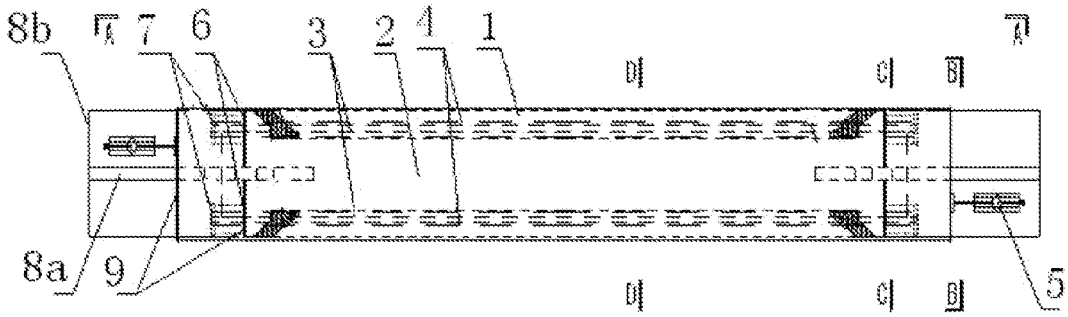
FIG. 1 is a schematic configuration view of an embodiment of the present invention.
Figure 2:
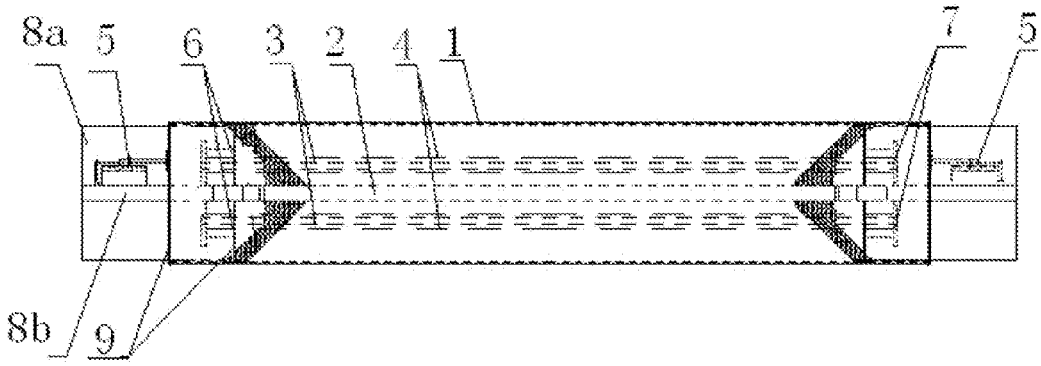
FIG. 2 is a side view of an A-A direction of FIG. 1.
Figure 3:
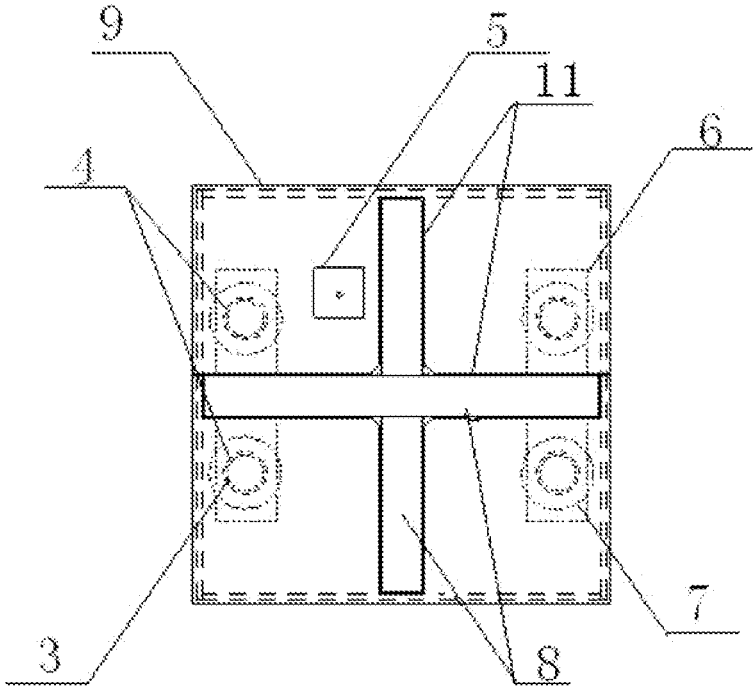
FIG. 3 is a schematic view of a B-B section of FIG. 1.
Figure 4:
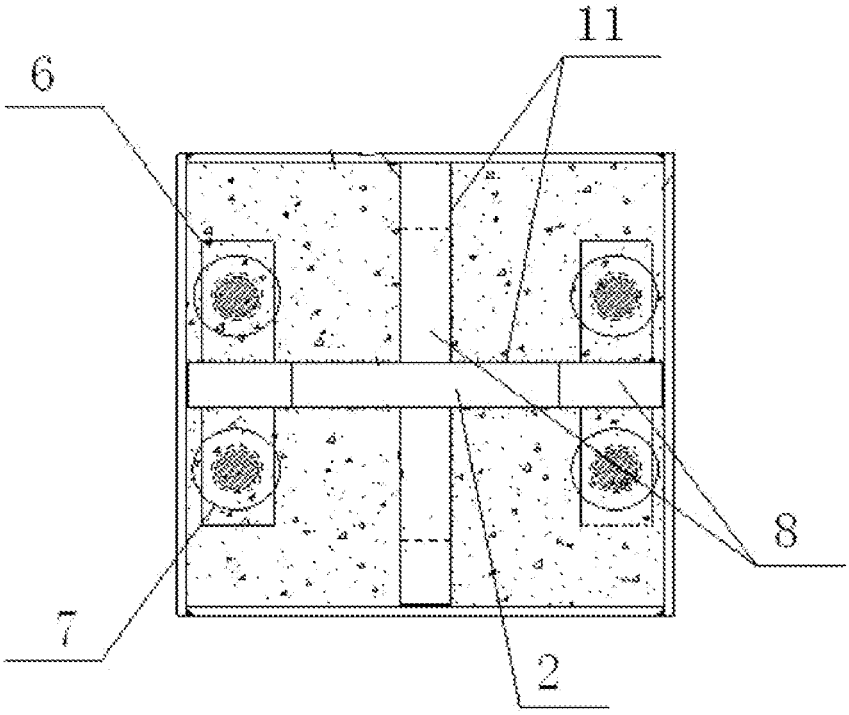
FIG. 4 is a schematic view of a C-C section of FIG. 1.
Figure 5:
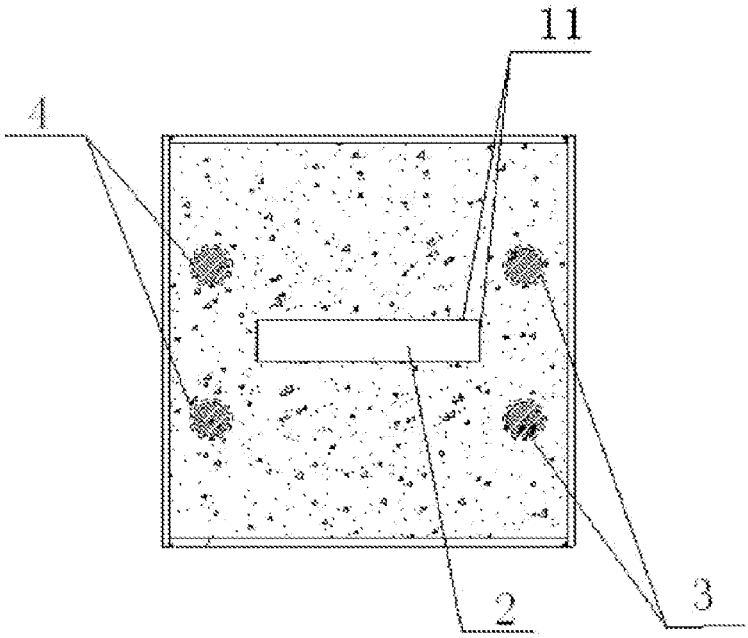
FIG. 5 is a schematic view of a D-D section of FIG. 1.
Figure 7:
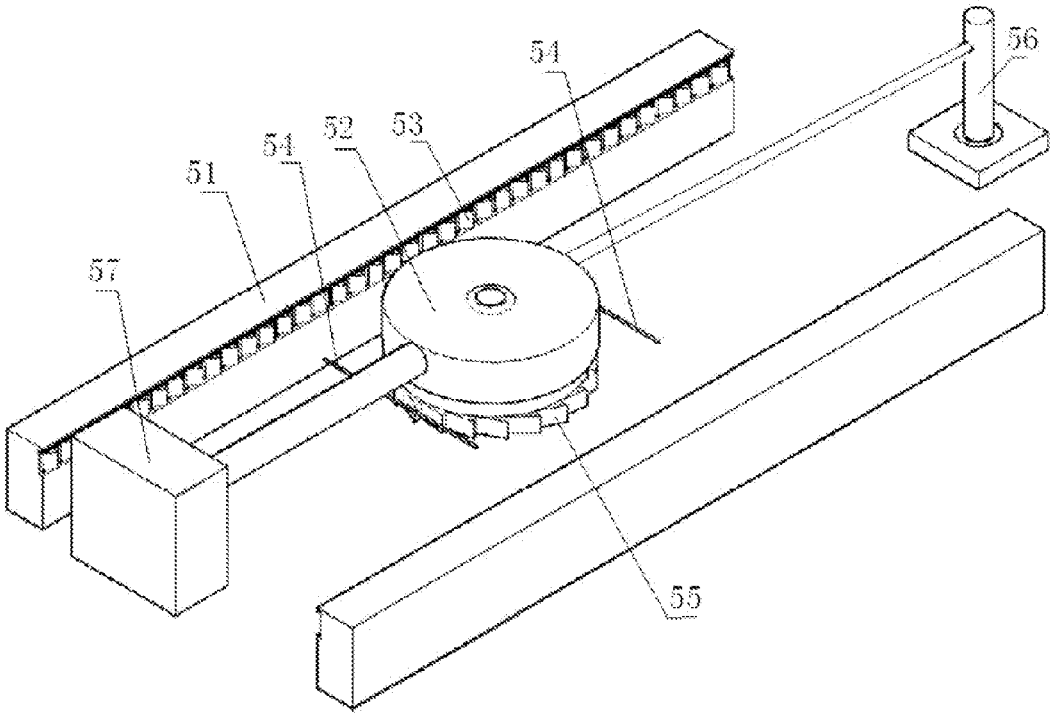
FIG. 7 is a schematic view of a brace deformation recording device.
Figure 8:
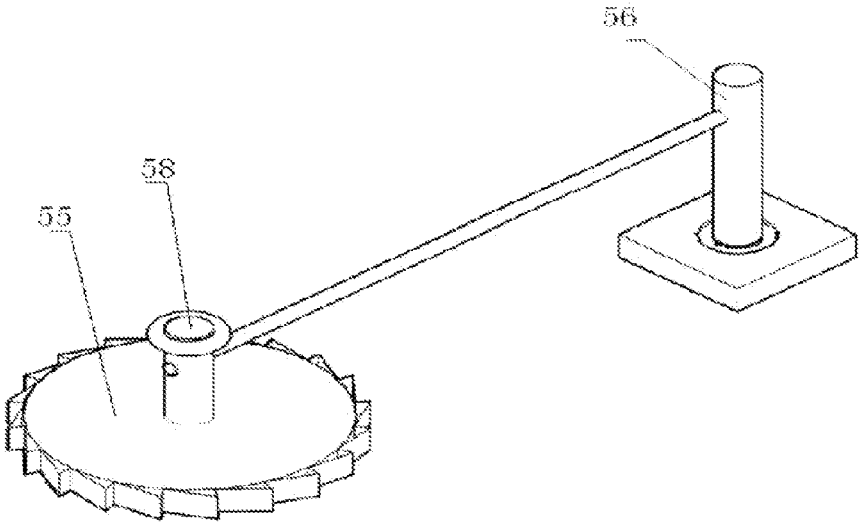
FIG. 8 is a connection view of a first cord spool and a second cord spool.

FIG. 1 is a specific structural view of a seismic-incurred-rupture-resistant deformation-recordable buckling-restrained brace, which includes a concrete filled steel tubular outer sleeve 1, a core plate 2 being disposed in the concrete filled steel tubular outer sleeve, an end portion of the core plate being provided with a core plate stiffening rib 8, and further includes a brace deformation recording device 5. The brace deformation recording device 5 includes two toothed racks 51, a ratchet gear 55, a first cord spool 58, and a second cord spool 56 (as shown in FIG. 7 and FIG. 8). The two toothed racks 51 are fixed on the core plate stiffening rib 8. The ratchet gear 55 is connected to the concrete filled steel tubular outer sleeve 1. A row of ratchet pawls 53 is disposed on a length direction of each toothed rack 51. The direction of the ratchet pawls on one toothed rack is opposite to that of the ratchet pawls on the other toothed rack. Two sides of the ratchet gear are engaged with the ratchet pawls 53 on the two toothed racks respectively. The first cord spool 58 is fixed on a shaft center of the ratchet gear. The second cord spool 56 is fixed on the core plate stiffening rib 8. One end of a cord is wound on the second cord spool, and the other end of the cord is fixed on the first cord spool. When deforming, the core plate drives the two toothed racks to move relative to the concrete filled steel tubular outer sleeve 1. The ratchet pawl drives the ratchet gear and the first cord spool to rotate in a unidirectional manner, and winds a part of the cord from the second cord spool onto the first cord spool. In the brace deformation recording device of the present invention, when the buckling-restrained brace is subject to a tension/compression force, the core plate undergoes deformation under tension/compression and drives the toothed racks to move, and the toothed racks drive the ratchet gear and the first cord spool to rotate, so as to wind the cord from the second cord spool onto the first cord spool. The cord spool rotate to wind the cord, so as to record the accumulated deformation amount. According to the recorded accumulated deformation amount, the degree of damage to the buckling-restrained brace is determined, which provides data support for decision of whether post-earthquake replacement is required.

Figure 9:
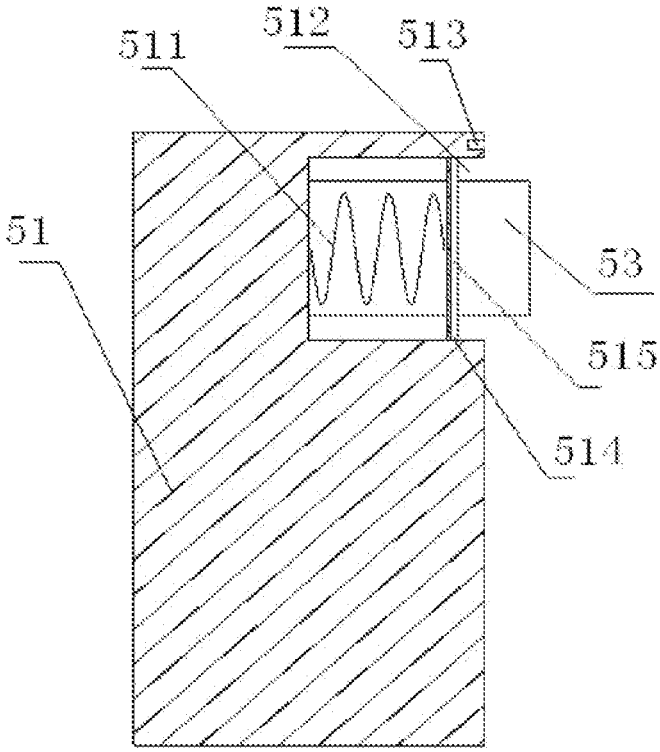
FIG. 9 is a vertical sectional view of a mounting slot.

As shown in FIG. 7, FIG. 8 and FIG. 9, a specific structure of the brace deformation recording device of the present invention is: the toothed rack 51 is provided with a mounting slot 512 along the length direction, an extendable and retractable mechanism that extends and retracts along a depth direction of the mounting slot 512 is disposed in the mounting slot 512, and the ratchet pawls 53 are disposed in the mounting slot and connected to the extendable and retractable mechanism. When the tooth on the ratchet pawl hinders the ratchet gear from rotating, the ratchet gear presses the ratchet pawl into the mounting slot. After the ratchet gear rotates and passes the ratchet pawl, the extendable and retractable mechanism pushes the ratchet pawl to an original position thereof. Furthermore, the two toothed racks ensure that the ratchet gear always rotates along one direction, so as to accumulate the deformation amount of the buckling-restrained brace.

Figure 10:
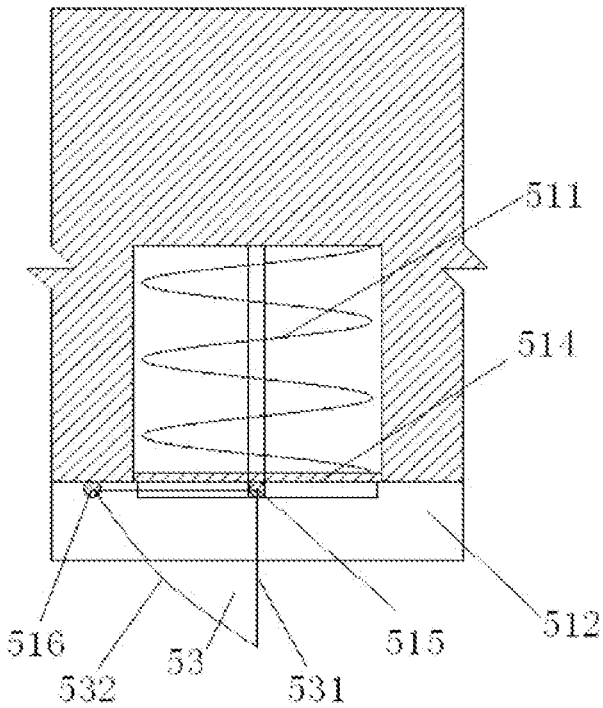
FIG. 10 is a partial horizontal sectional view of a mounting slot.

As shown in FIG. 9 and FIG. 10, in order to better make the ratchet gear rotate always in one direction, each ratchet pawl 53 includes a first side surface 531 and a second side surface 532. Top portions of the first side surface 531 and the second side surface 532 converge to form an acute angle. A root portion of the first side surface 531 is connected to a first pin 515. The first pin 515 is connected to an extendable and retractable mechanism. The extendable and retractable mechanism is located in an extension and retraction slot. A pin slide slot along a depth direction of the extension and retraction slot is disposed in the extension and retraction slot. Two ends of the first pin 515 are inserted into the pin slide slot, and can slide in the pin slide slot. A root portion of the second side surface 532 is connected to a second pin 516. The second pin 516 is fixedly mounted in the mounting slot. The extendable and retractable mechanism includes a spring 511 and a jamming plate 514. The spring 511 is disposed along the depth direction of the extension and retraction slot, and has one end fixed on a bottom portion of the extension and retraction slot and the other end fixed on the jamming plate 514. The first pin 515 is disposed in front of the jamming plate 514. When the second side surface 532 of the ratchet pawl is under compression, the spring is compressed, so that the ratchet pawl 53 enters the mounting slot. Then, the spring 511 pushes the ratchet pawl to the original position thereof through the jamming plate 514 and the first pin 515. When the first side surface 531 of the ratchet pawl is under compression, since the second pin is stationary, the ratchet pawl pokes the ratchet gear to rotate. The extension and retraction structure is not limited to the aforementioned structure, as long as that the ratchet pawl under compression does not hinder the ratchet gear from rotating and retracts into the mounting slot, and the ratchet pawl not under compression is restored to the original position to be engaged with the ratchet gear.

Figure 11:
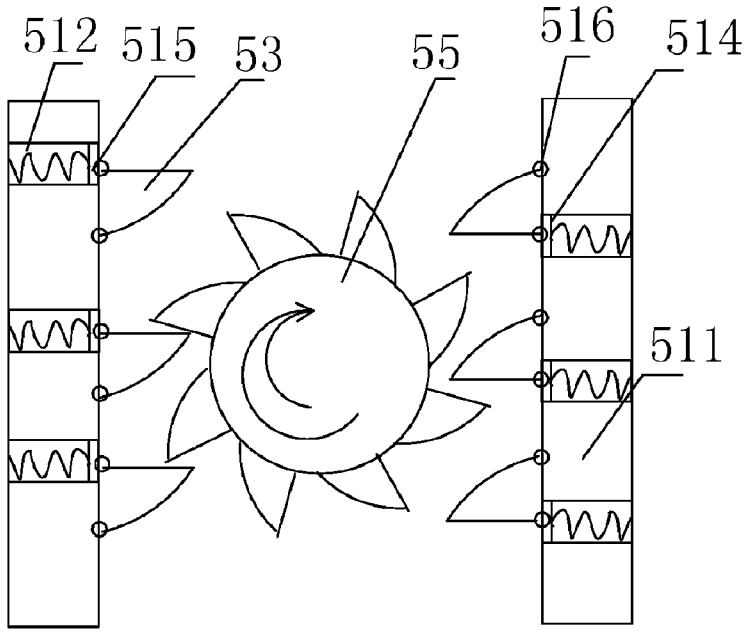
FIG. 11 is a schematic fit view of a ratchet gear and toothed racks.

As shown in FIG. 11, a working process of the brace deformation recording device is as follows. When the core plate under compression deforms, and it is assumed that the two toothed racks move downwards, the first side surface 531 of the ratchet pawl on the right toothed rack contacts the ratchet gear 55, and the ratchet pawl 53 does not retract and pokes the ratchet gear 55 to rotate clockwise; the second side surface 532 of the ratchet pawl on the left toothed rack contacts the ratchet gear, the ratchet pawl under compression retracts into the mounting slot 512, so that the ratchet gear rotates normally. When the core plate under tension deforms, the two toothed racks move upwards, the second side surface of the ratchet pawl 53 on the right toothed rack contacts the ratchet gear 55, in this case the ratchet pawl on the right toothed rack retracts, and the ratchet pawl on the left toothed rack pokes the ratchet gear to continue to rotate clockwise. Therefore, not matter the core plate deforms under compression or tension, the brace deformation recording device always makes the ratchet gear to rotate clockwise, so as to wind the cord from the second cord spool onto the first cord spool, thereby recording the accumulated deformation amount of the brace.

Inner sides of the two toothed racks 51 are each provided with a pointer slide slot 513 along the length direction. The brace deformation recording device 5 further includes two pointers 54 (as shown in FIG. 7). The two pointers 54 are located on two sides of the ratchet gear 55 respectively. Two ends of each of the pointers are inserted into the pointer slide slots 513 on the two toothed racks. When the core plate moves relative to the concrete filled steel tubular outer sleeve, the pointers pushed by the ratchet gear 55 slide inside the pointer slide slot 513 and stop at a maximum position. Furthermore, scales for indicating a length are marked inside the pointer slide slots. The ratchet gear is fixedly connected to the concrete filled steel tubular outer sleeve, and the toothed rack is fixedly connected to the stiffening rib of the core plate, so that when the core plate moves relative to the concrete filled steel tubular outer sleeve, the pointers move inside the pointer slide slots and stop at the maximum position where the core plate moves. Therefore, by reading scale values where the pointers on the two sides stop in the pointer slide slots, a maximum deformation value under tension and a maximum deformation value under compression of the buckling-restrained brace are obtained.

As shown in FIG. 8, a ratchet gear cover 52 is disposed above the ratchet gear 55. The first cord spool 58 has one end fixed on the ratchet gear and the other end disposed in a bearing on the ratchet gear cover 52. The ratchet gear cover 52 is fixedly connected to the end portion of the concrete filled steel tubular sleeve 1 through a magnet block 57.

In order to enhance the seismic-incurred-rupture-resistant function of the present invention, as shown in FIG. 1, FIG. 2, FIG. 3, FIG. 4 and FIG. 5, multiple cables 3 are symmetrically distributed in the concrete filled steel tubular outer sleeve. Two ends of each of the cables 3 are fixed on the core plate stiffening rib 8 at the two ends of the core plate through an anchorage device 7. End portions of the concrete filled steel tubular outer sleeve are provided with two sealing plates 9, namely, the front one and the rear one. A fixing plate 6 is disposed between the two sealing plates 9. The cables run through the front sealing plate and the fixing plate 6, and then are fixed through the anchorage device. The fixing plate 6 is disposed in front of the anchorage device 7, and is used to prevent the cables from retracting and provide additional tension bearing capacity for the brace. The fixing plate is provided with holes in the length direction, so that the cables can run through the holes and deform freely.

Figure 12:
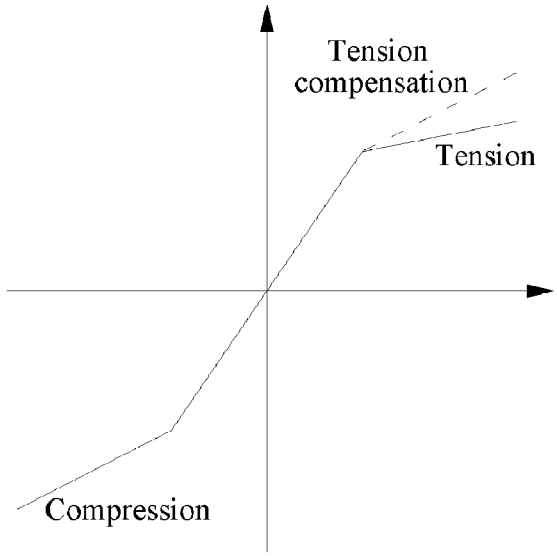
FIG. 12 is a schematic broken line view of tension and compression compensation according to the present invention.

The cable 3 is inserted in a bushing 4. The bushing 4 is a polyvinyl chloride (PVC) pipe, and is positioned prior to pouring of concrete. End portions of the bushing are disposed deep into the hole inside the fixing plate in front of the anchorage device. The cable 3 is inserted into the bushing 4, so as to prevent the cable from being bound to poured lightweight concrete and being deprived of the original function. The cables are high strength steel strands or fiber-reinforced polymer material wires. After the seismic-incurred-rupture-resistant function is added to the buckling-restrained brace, the defect of asymmetric tension and compression in the buckling-restrained brace is compensated. The generation mechanism of the asymmetric tension and compression is as follows. When under compression, the section of the brace becomes bigger, the friction force of the core plate increases, and the Poisson effect is incurred, so that the bearing capacity of the brace increases. When under tension, the section of the brace becomes smaller, and the friction force of the core plate decreases, so that the bearing capacity of the brace decreases. As shown in FIG. 12, in the drawing, the solid line is the broken line of a buckling-restrained brace without any cable, where the tension broken line and the compression broken line are not symmetric; the dotted line is the tension broken line after the cable is added for compensation, and after the cable is added, the tension broken line and the compression broken line are symmetric. Furthermore, the compensation point may be adjusted by setting the free deformation length of the cable according to needs.

Figure 6:
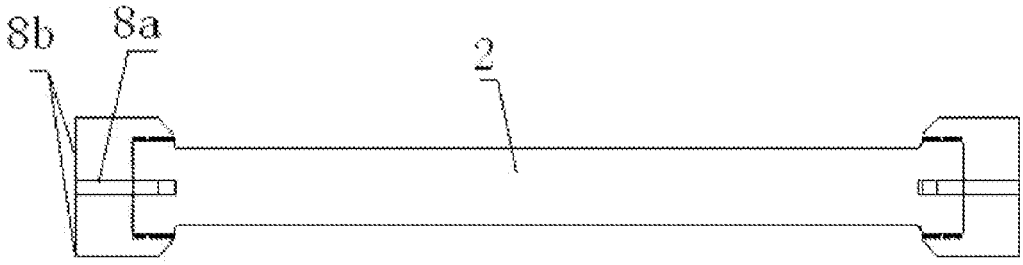
FIG. 6 is a schematic structural view of a core plate according to the present invention.

As shown in FIG. 6, two ends of the core plate 2 each are provided with the core plate stiffening rib 8. The core plate stiffening rib includes a stiffening rib 8*b* parallel with the core plate and a stiffening rib 8*a* perpendicular to the core plate. The two stiffening rib form a cross shape, thereby increasing the brace capacity of the core plate. A compressible delamination adhesive material layer 11 may be arranged around the core plate. The compressible delamination adhesive material layer may be such as a polystyrene foam plate.

In summary, a seismic-incurred-rupture-resistant buckling-restrained brace of the present invention includes a core part, a concrete filled steel tubular outer sleeve part, a dual-function part, and a brace deformation recording part. The core part includes the core plate 2 and the core plate end portion stiffening rib 8. The concrete filled steel tubular outer sleeve part is formed of a square steel tube and concrete. The dual-function part includes the cable 3, the bushing 4, and the anchorage device 7, and in addition to the seismic-incurred-rupture-resistant function, this part further has the function of compensating the asymmetric tension and compression. The brace deformation recording part is formed of the brace deformation recording device 5 for measuring the accumulated deformation and the maximum deformation. The concrete filled steel tubular outer sleeve 1 is isolated from the core plate 2 by using the compressible delamination adhesive material 11. The cable 3 is placed inside the bushing 4, two ends thereof are fixed on the core plate stiffening rib 8 at the two ends of the core plate through the anchorage device 7, and certain laxity is kept. The laxity length of the cable is determined according to an expected deformation amount during strong earthquakes and requirements on the compensation of asymmetric tension and compression, so as to ensure that when the core plate ruptures during strong earthquakes, the bearing capacity lost by the brace can be provided by the cable, thereby preventing the formation of a weak layer in the structure. The brace deformation recording device 5 can record the accumulated plastic deformation and the maximum deformation undergone by the brace during earthquakes, so as to provide reliable basis for determination of the degree of damage to the brace and whether post-earthquake replacement is required. In the concrete filled steel tubular outer sleeve part, an inner wall of the square steel tube outer sleeve is close to the core plate stiffening rib. A longitudinal reserved distance of the core plate stiffening rib and the square steel tube outer sleeve is a compression distance of the brace. Compared with a regular buckling-restrained brace, the present invention achieves greater safety and better mechanical properties, can prevent adverse effects incurred to the structure by the fatigue rupture of the brace, and can record the accumulated deformation and the maximum deformation of the brace.

A fabricating method of a seismic-incurred-rupture-resistant deformation-recordable buckling-restrained brace of the present invention includes the following steps:

(1) fabricating a core plate part: welding a core plate 2 and a stiffening rib 8*b* parallel with the core plate together through a butt weld, and welding the core plate 2 and a stiffening rib 8*a* perpendicular to the core plate together through a fillet weld;

(2) welding a fixing plate 6 and the core plate stiffening rib 8 together through a fillet weld, and preparing a hole on the fixing plate 6;

(3) placing a cable 3 into a bushing 4, an end portion of the cable running through the hole of the fixing plate 6, and using an XM model clip type anchorage device 7 for anchoring;

(4) arranging a compressible delamination adhesive material layer 11 around the core plate;

(5) placing a front sealing plate in front of the fixing plate 6, welding the front sealing plate and an inner wall of a square steel tube together through a fillet weld, pouring lightweight concrete into the square steel tube, and fixedly placing another front sealing plate in front of another fixing plate, so as to fabricate a concrete filled steel tubular outer sleeve 1;

(6) welding two rear sealing plates and cross-sections at two ends of the square steel tube together through fillet welds; and (7) mounting and fixing a brace deformation recording device 5, the brace deformation recording device including two toothed racks 51, a ratchet gear 55, a first cord spool 58, and a second cord spool 56, fixing the two toothed racks on the core plate stiffening rib 8, connecting the ratchet gear 55 to the rear sealing plate, disposing the ratchet gear between the two toothed racks, a tooth on the ratchet gear being engaged with a ratchet pawl on the toothed rack, the ratchet gear driven by the toothed rack rotating, fixing a first cord spool 58 on the ratchet gear 55, fixing a second cord spool 56 on the core plate stiffening rib 8, winding a cord onto the second cord spool, and fixing an end portion of the cord on the first cord spool.

A specific fabricating method of the brace deformation recording device is as follows: (1) preparing a mounting slot along a longitudinal axis direction of the toothed rack 51, preparing multiple extension and retraction slots inside the mounting slot, preparing a pin slide slot along a depth direction of the extension and retraction slot, preparing a pointer slide slot 513 at a top portion of the toothed rack; fixing the second pin 516 on the mounting slot near the extension and retraction slot; (2) placing a spring 511 into the extension and retraction slot, and placing a jamming plate 514 at a frond end portion of the spring; (3) placing a first pin 515 into a corresponding pin slide slot, and fixing ratchet pawls 53 made of steel sheets on the first pin and the second pin; (4) connecting the two toothed racks 51 to the core plate stiffening rib 8 through fillet welds respectively, and after the two toothed racks 51 are positioned, placing a pointer 54 at a preset position; (5) fixing the second cord spool 56 on the core plate stiffening rib 8; (6) fixing the ratchet gear 55 and the first cord spool 58 together, winding one end of a cord on the second cord spool, and fixing the other end of the cord on the first cord spool without winding; and (7) connecting the first cord spool 58 and a bearing in the ratchet gear cover together, connecting the ratchet gear cover 52 and a magnet block 57 together, and using the rear sealing plate to attract the magnet block 57 thereon.

What is claimed is:

1. A seismic-incurred-rupture-resistant deformation-recordable buckling-restrained brace, comprising a concrete filled steel tubular outer sleeve (1), a core plate (2) being disposed in the concrete filled steel tubular outer sleeve, an end portion of the core plate being provided with a core plate stiffening rib (8), and further comprising a brace deformation recording device (5), wherein the brace deformation recording device comprises two toothed racks (51), a ratchet gear (55), a first cord spool (58), and a second cord spool (56), the two toothed racks are fixed on the core plate stiffening rib (8), the ratchet gear (55) is connected to the concrete filled steel tubular outer sleeve (1), a row of ratchet pawls (53) is disposed on a length direction of each toothed rack (51), the direction of the ratchet pawls on one toothed rack is opposite to that of the ratchet pawls on the other toothed rack, two sides of the ratchet gear are engaged with the ratchet pawls on the two toothed racks respectively, the first cord spool (58) is fixed on a shaft center of the ratchet gear, the second cord spool (56) is fixed on the core plate stiffening rib (8), one end of a cord is wound on the second cord spool, the other end of the cord is fixed on the first cord spool, and when deforming, the core plate drives the two toothed racks to move relative to the concrete filled steel tubular outer sleeve (1), and the ratchet pawl drives the ratchet gear and the first cord spool to rotate in a unidirectional manner, and winds a part of the cord from the second cord spool onto the first cord spool.

2. The buckling-restrained brace as in claim 1, wherein the toothed rack is provided with a mounting slot (512) along the length direction, the ratchet pawls (53) are disposed in the mounting slot, each ratchet pawl comprises a first side surface (531) and a second side surface (532), top portions of the first side surface and the second side surface converge to form an acute angle, a root portion of the first side surface is connected to a first pin (515), the first pin (515) is connected to an extendable and retractable mechanism, the extendable and retractable mechanism is located in an extension and retraction slot, a pin slide slot along a depth direction of the extension and retraction slot is disposed in the extension and retraction slot, two ends of the first pin (515) are able to slide in the pin slide slot, a root portion of the second side surface is connected to a second pin (516), and the second pin is fixedly mounted in the mounting slot.

3. The buckling-restrained brace as in claim 1, wherein inner sides of the toothed racks are each provided with a pointer slide slot (513) along the length direction, the brace deformation recording device (5) further comprises two pointers (54), the two pointers are located on two sides of the ratchet gear (55) respectively, and two ends of each of the pointers are inserted into the pointer slide slots (513) on the two toothed racks.

4. The buckling-restrained brace as in claim 1, wherein one end of the core plate stiffening rib (8) is located outside the concrete filled steel tubular outer sleeve, and the brace deformation recording device (5) is disposed on the core plate stiffening rib outside the concrete filled steel tubular outer sleeve.

5. The buckling-restrained brace as in claim 1, wherein the ratchet gear (55) is provided with a ratchet gear cover (52), the first cord spool (58) has one end fixed on the ratchet gear and the other end disposed in a bearing on the ratchet gear cover and the ratchet gear cover (52) is fixedly connected to the end portion of the concrete filled steel tubular sleeve.

6. The buckling-restrained brace as in claim 1, wherein multiple cables (3) are symmetrically distributed in the concrete filled steel tubular outer sleeve, and two ends of each of the cables are fixed on the core plate stiffening rib (8) at the two ends of the core plate.

7. The buckling-restrained brace as in claim 6, wherein two ends of the concrete filled steel tubular outer sleeve are provided with two sealing plates (9), namely, the front one and the rear one, a fixing plate (6) is disposed between the two sealing plates, the fixing plate (6) is fixed on the core plate stiffening rib, and the cables (3) run through the front sealing plate and the fixing plate, and then are fixed through an anchorage device.

8. The buckling-restrained brace as in claim 6, wherein the cable (3) is inserted into a bushing (4).

* * * * *